US005703304A

United States Patent [19]

Lindberg et al.

[11] Patent Number: 5,703,304

[45] Date of Patent: Dec. 30, 1997

[54] IRON-BASED POWDER CONTAINING CHROMIUM, MOLYBDENUM AND MANGANESE

[75] Inventors: Caroline Lindberg, Höganäs; Per Engdahl, Nyhamnsläge, both of Sweden

[73] Assignee: Höganäs AB, Sweden

[21] Appl. No.: 776,821

[22] PCT Filed: Aug. 10, 1995

[86] PCT No.: PCT/SE95/00917

§ 371 Date: Feb. 6, 1997

§ 102(e) Date: Feb. 6, 1997

[87] PCT Pub. No.: WO96/05007

PCT Pub. Date: Feb. 22, 1996

[30] Foreign Application Priority Data

Aug. 10, 1994 [SE] Sweden ..... 9402672

[51] Int. Cl.[6] ..... B22F 3/12; C22C 1/24; C22C 1/25

[52] U.S. Cl. ..... 75/243; 75/246; 75/252; 419/11; 419/38; 419/46

[58] Field of Search ..... 419/11, 36, 48; 75/246, 243, 255, 252; 420/90, 93, 101, 105, 123, 129

[56] References Cited

U.S. PATENT DOCUMENTS

| | | | |
|---|---|---|---|
| 4,266,974 | 5/1981 | Nitta et al. | 75/251 |
| 4,943,321 | 7/1990 | Akutsu | 75/243 |
| 5,007,956 | 4/1991 | Fujita et al. | 75/238 |
| 5,141,554 | 8/1992 | Kijima | 75/246 |
| 5,158,601 | 10/1992 | Fujika et al. | 75/246 |
| 5,326,526 | 7/1994 | Ikenoue et al. | 419/38 |
| 5,370,725 | 12/1994 | Kawamura et al. | 75/243 |
| 5,507,257 | 4/1996 | Sakai et al. | 123/188.3 |
| 5,534,045 | 7/1996 | Ogura et al. | 75/243 |

FOREIGN PATENT DOCUMENTS

| | | |
|---|---|---|
| 51-59707 | 5/1976 | Japan . |
| 61-276949 | 12/1986 | Japan . |
| 606889 | 4/1978 | U.S.S.R. . |
| WO94/14557 | 7/1994 | WIPO . |

*Primary Examiner*—Daniel J. Jenkins

*Attorney, Agent, or Firm*—Burns, Doane, Swecker & Mathis, L.L.P.

[57] ABSTRACT

The invention concerns an iron-based powder for powder-metallurgically producing components by powder compacting and sintering. The powder which essentially consists of 0.7–2.0% of Mo, 0.2–2.5% by weight of Cr and 0–3.0% by weight of Cu, 0.05–0.25% by weight of Mn and 0.3–1.0% by weight of C, wherein Fe, Mo and Mn are present as a prealloyed, water atomised FeMoMn base powder, Cr is present as FeCr, Cu is present as a metal or partially prealloyed powder and C is present as a graphite, exhibits very interesting properties. The invention also includes a method for preparing sintered components from this iron powder.

20 Claims, No Drawings

IRON-BASED POWDER CONTAINING CHROMIUM, MOLYBDENUM AND MANGANESE

The present invention is related to an iron-based powder for producing components by compacting and sintering. Specifically the invention concerns powder compositions which are essentially free from nickel and which, when sintered, give components having valuable properties, such as high tensile strength. The components can be used within e.g. the automotive industry. The invention also concerns a powder-metallurgically produced component of this powder as well as a method of powder-metallurgically producing such a component.

Nickel is a relatively common alloying element in iron-based powder compositions in the field of powder-metallurgy, and it is generally known that nickel improves the tensile strength of the sintered components which have been produced by iron powders containing up to 8% of nickel. Additionally, nickel promotes sintering, increases the hardenability and has positive influence on the elongation at the same time. There is, however, an increasing demand of powders which do not contain nickel as i.a. nickel is expensive, gives dusting problems during the processing of the powder, causes allergic reactions in minor amounts. From an environmental point of view the use of nickel should thus be avoided.

The problem behind the present invention is thus to find a nickel free powder composition having at least in some respects essentially the same properties as compositions containing nickel.

Alloying systems which are currently commercially used in this connection contain Fe—Cu—C and to some extent Fe—Mo—Cu—C. These two materials have a relatively high tensile strength (400–700 MPa). High tensile tent Fe—Mo—Cu—C. These two materials have a relatively high tensile strength (400–700 MPa). High tensile strength (>700 MPa) can be obtained with Fe—Mo—Cu—C material after sintering in furnaces, in which convective cooling can be used. The development of the compositions according to the present invention has quite unexpectedly made it possible to increase the tensile strength to values above 800 MPa also without convective cooling.

According to the present invention metal powders which, in addition to iron, essentially consist of 0.7–2.0% of Mo, 0.2–2.5% by weight of Cr and 0–3.0% by weight of Cu, 0.05–0.25% by weight of Mn and 0.3–1.0% by weight of C, wherein Fe, Mo and Mn are present as a prealloyed, water atomised FeMoMn base powder, Cr is present as FeCr, Cu is present as a metal powder or partially prealloyed to the above mentioned base powder exhibit very interesting properties. Thus, tensile strengths above 650 MPa can be obtained, when the metal powders according to the invention are pressed and then sintered at high temperatures.

Metal powders including Fe, Mo, Mn, Cr and C are previously known from i.a. the Japanese patent publication JP-A-61-276 949. This publication concerns an invention, which is intended to solve problems with heat treated products having insufficient surface hardness or strength after nitriding. The problems are solved by the manufacture of a green body including 0.5–6.0% Cr, 0.2–0.6% C and at least one of 0.3–1.5% by weight Mn, 0.1–2.0% by weight of Mo, 0.2–2.0% by weight of Cu and 0.2–3.0% by weight of Ni, the rest being Fe, which body is sintered and then subjected to a nitriding treatment. The green body is made from a completely pre-alloyed powder or from mixing FeCr, FeMn, Cu, Mo, Ni and other powders into a pure iron-powder. The present invention concerns quite another problem, namely to provide nickel-free products which, when sintered, are distinguished by e.g. high tensile strength. The known powders differ from the powders according to the present invention i.a. as regards the Mn-content, which according to the present invention should be between 0.05 and 0.25%, whereas in the known powder, if present, Mn should be in the range of 0.3 to 1.5%. The lower Mn content according to the present invention is of importance to avoid oxidation during water atomisation and to keep good compressibility of the powder. Additionally, in the actual examples of the Japanese publication, the Mo-content is clearly below the Mo-content according to the present invention. Furthermore, according to the present invention, Fe, Mn and Mo are present as a water atomised prealloyed FeMnMo base powder, whereas all the known powders are prepared by oil atomisation (cf. the examples, page 6), which is considerably more expensive than water atomisation. In brief, the powder according to the present invention has a different composition, includes the elements in different forms, are made by different processing routes and are used for solving other problems than the powder, which is known from the Japanese publication.

Another publication, which discloses metal powders including Fe, Mo, Mn, Cr and C is the PCT-application CA92/00556. This publication concerns a method of producing bearing surfaces having high ductility properties or rollable properties. A major difference between this known powder and the powder according to the present invention is the type of base powder, which according to the PCT publication is a powder of elementary iron, to which all the alloying elements are admixed, whereas the base powder according to the present invention is a prealloyed, water atomised FeMoMn powder. One advantage of using water atomised prealloyed bass powder is that segregation problems are reduced and the majority of the grinding steps required according to the PCT publication can be avoided. Another advantage is that the distribution of alloying elements after sintering is improved, which in turn results in an improved dimensional stability and a more uniform and increased strength. Furthermore, by using the specific forms and amounts of alloying elements according to the present invention, it is possible to avoid the expensive oil atomising process which is an established way of incorporating Mn and Cr (cf the PCT publication, page 2, first paragraph). The PCT publication teaches that powders having rollable properties may include low amounts of Mn. It is however critical that Mn is present in the powder in the form of an FeMn alloy including e.g. approximatively 78% Mn and having a mean particle size of approximately 8 to 12 micron and not in the form of a FeMoMn base powder as in the present invention. Also Mo should be in the form of a ferroalloy (it is suggested that the FeMo alloy includes approximately 71% Mo and has a mean particle size between 8 and 12 micron), whereas essentially all the Mo (as well as essentially all the Fe and Mn) in the powder according to the present invention is present in the form of the water atomised FeMoMn powder. The sintered product prepared from the previously known powder is subjected to rolling and heat treating steps in order to produce a densified layer, whereas the products according to the present invention are intended for use directly without any subsequent treatment. Thus, the powder compositions known from the PCT publication differ from the present compositions both as regards the form and the intended use.

Additionally, this PCT patent publication teaches away from the use of copper as an alloying element in combination with carbon when high temperature sintering is used. In contrast, we have found that remarkably good results can be obtained with conventional high temperature sintering if Cu in an amount of up to 3% by weight is added to water atomised FeMoMn powders as in the present invention.

SE-B-447071 (corresponding to U.S. Pat. No. 4,266,974) discloses an alloy steel powder including, in addition to iron, at least one of the elements Mn, Cr, Mo and V. The amounts of these elements, if present, are 0.35 to 1.5% by weight of Mn, 0.2 to 5.0% by weight of Cr, 0.1 to 7.0% by weight of Mo and 0.01 to 1.0% by weight of V. As discussed above it is essential that the Mn content is below 0.3 in the powder according to the present invention in order to avoid oxidation problems during the water atomisation.

SU,A 606 889 concerns an iron powder including high amounts (5–7%) of $CaF_2$as a necessary ingredient. When sintered this powder results in a product having high wear resistance and low friction coefficient. Accordingly, this publication does not teach the composition of the powder according to the present invention nor the properties of the product as sintered.

The amounts and forms of the alloying elements used in the powder according to the present invention are discussed in furher detail below.

The base powder, which is prepared by water atomisation of a melt consisting of Fe, Mo and Mn, has a particle size less than 250 micron and a mean particle size of about 100 micron. Suitable base powder are Astaloy Mo and Astaloy 85 Mo both available from Höganäs AB, Sweden.

When Mo is included in the iron powder the hardenability of the compressed material is increased and it is recommended that the amount of Mo should be at least 0.7% by weight. As however increasing amounts of Mo result in decreased compressibility and, accordingly, decreased density, the amount of Mo should preferably be less than about 2.0% by weight. Most preferably the Mo content varies between 0.75 and 1.7% by weight.

The purpose of the Cr addition is to increase the hardenability of the material and to form carbides. This imparts an improved tensile strength and hardness to the sintered product. Cr is preferably added as FeCr. It is also preferred that the FeCr material does not include C as this would increase the wear on the die. The use of high temperature sintering, i.e. sintering above 1150° C., usually about 1250° C., leads to good distribution of Cr at the same time as Cr oxidation is avoided. Too high Cr content results in a sintered material which is too brittle. Preferably the Cr content varies between 0.4 and 1.8% by weight.

Cu forms a liquid phase during the sintering which facilitates the distribution of melting phase and makes the pores rounder. Additionally, Cu increases the hardenability of the compressed material and the tensile strength of the sintered material is increased. High amounts of Cu affects the density negatively due to swelling. Preferably the amount of Cu varies between 1 and 2.5% by weight.

Mn improves the hardenability. However, high amounts of Mn i.e. more than 0.3% by weight result in decreased compressibility and can cause oxidation problems. Preferably the amount of Mn varies between 0.08 and 0.18% by weight.

If the amount of C, which is normally added as a graphite powder, is less than 0.3 % the tensile strength will be too low and if the amount of C is above 1.0 the sintered component will be too brittle. Preferably the amount of C varies between 0.3 and 0.8% by weight. Components prepared from compositions according to the present invention, wherein the C content is relatively low, exhibit good ductility and acceptable tensile strength, whereas products prepared from compositions having higher amounts of C have lower ductility and increased tensile strength.

According to a preferred embodiment of the invention Astaloy® Mo (available from Höganäs AB, Sweden) is used as a base powder. To this powder which contains 1.5% Mo is added Cu as a metal powder or is partially prealloyed, Cr is added in the form of FeCr and C in the from of graphite. 0.8% zinc stearate was added to all mixes for lubrication.

The invention is described more in detail in the following example.

EXAMPLE

Tensile strength testbars were pressed at 580–600 MPa and were sintered at temperatures >1150° C. in high temperatue furnaces. The sintering time was 30 minutes and the atmosphere was 95/5 $N_2H_2$. (Also other atmospheres having low dew point can be used for the sintering process).

The results are summarized in the following table, wherein "HV10" is Vicker hardness, "TS" is tensile strength and "A" is elongation.

| Material | % Mo | % Cu | % Cr | % Mn | % C | HV10 | TS MPa | A % | T °C. | t min |
|---|---|---|---|---|---|---|---|---|---|---|
| 1. | 1.5 | 2.0 | 1.5 | 0.1 | 0.4 | 244 | 929 | 1.6 | 1250 | 30 |
| 2. | 1.5 | 2.0 | — | 0.1 | 0.4 | 185 | 646 | 1.5 | 1250 | 30 |
| 3. | 1.5 | — | 1.5 | 0.1 | 0.7 | 221 | 797 | 1.4 | 1250 | 30 |
| 4. | 1.5 | 2 | 0.8 | 0.1 | 0.4 | 206 | 795 | 1.8 | 1250 | 30 |
| 5. | 1.5 | 2 | 1.5 | 0.1 | 0.4 | 230 | 567 | 2.0 | 1120 | 30 |
| 6. | — | 2 | — | — | 0.4 | 174 | 492 | 4.4 | 1120 | 30 |
| 7. | 0.75 | 2 | 0.5 | 0.05 | 0.4 | 187 | 697 | 2.2 | 1250 | 30 |
| 8. | 0.75 | — | 2.5 | 0.05 | 0.4 | 218 | 750 | 0.8 | | |
| 9. | 1.5 | — | 3 | 0.1 | 0.4 | 242 | 726 | 0.5 | 1250 | 30 |
| 10. | 1.5 | 2 | 0.2 | 0.1 | 0.4 | 183 | 682 | 2.0 | 1250 | 30 |
| 11. | 1.5 | — | 1.5 | 0.1 | 0.1 | 124 | 492 | 3.3 | 1250 | 30 |
| 12. | 1.5 | 2 | 0.5 | 0.1 | 0.2 | 168 | 610 | 2.2 | 1250 | 30 |
| 13. | 1.5 | 2.5 | 0.5 | 0.1 | 0.4 | 219 | 753 | 1.4 | 1250 | 30 |

Material 2 is an earlier known composition leading to a tensile strength of 646 MPa after high temperature sintering at 1250° C. With an addition of 1.5% chromium according to the invention the tensile strength is increased 283 MPa up to 929 MPa without any significant decrease in elongation.

Other examples according to the invention all result in tensile strengths above 650 MPa and elongations of 0.8% or above. Different alloying contents result in different combinations of tensile strength and elongation.

Increased chromium content increases hardness and tensile strength. At additions >2.5% Cr the tensile strength starts to decrease due to brittleness.

The molybdenum has a very strong effect on the tensile strength due to its ability to increase the hardenability. The microstructure changes from ferrite/perlite to bainite or bainite/martensite and the tensile strength is improved.

The tensile strength is increased by increasing graphite additions and high strength materials with tensile strengths above 650 MPa are achieved at carbon contents of 0.3% or above. When exceeding 1.0% carbon the material becomes brittle and both tensile strength and elongation decreases.

Material 5 and 6 show that 1120° C. is a too low sintering temperature to give high strength. Material 5 reaches a tensile strength of 567 MPa whereas the same composition sintered at 1250° C. results in a tensile strength of 929 MPa.

We claim:

1. An iron-based powder for producing components by powder compacting and sintering essentially consisting of 0.7–2.0% by weight of Mo 0.2–2.5% by weight of Cr 0–3.0% by weight of Cu 0.05–0.25% by weight of Mn 0.3–1.0% by weight of C, the balance being Fe and not more than 1% by weight of inevitable impurities, characterised in that Fe,Mo and Mn are present as a prealloyed, water atomised FeMoMn base powder, Cr is present as FeCr, Cu is present as a metal powder or is partially prealloyed to the base powder and C is present as graphite.

2. A powder according to claim 1, characterised in that the amount of Mo is 0.75–1.7% by weight.

3. A powder according to claim 2, characterised in that the amount of Cr is 0.4–1.8% by weight.

4. A powder according to claim 3, characterised in that Cr is added as FeCr.

5. A powder according to claim 4, characterised in that FeCr is essentially free from C.

6. A powder according to the claim 1, characterised in that the amount of Cu is 1.0–2.5% by weight.

7. A powder according to claim 1, characterised in that the amount of Mn is 0.08–0.18% by weight.

8. A powder according to claim 1 characterised in that the amount of C is 0.3–0.8% by weight.

9. A method of powder-metallurgically producing sintered components, characterised by using an iron-based powder which in addition to iron essentially consists of 0.7–2.0% by weight of Mo 0.2–2.5% by weight of Cr 0–3.0% by weight of Cu 0.05–0.25% by weight of Mn 0.3–1.0% by weight of C, the balance being Fe and not more than 1% by weight of inevitable impurities, wherein Fe,Mo and Mn are present as a prealloyed, water atomised FeMoMn base powder, Cr is present as FeCr, Cu is present as a metal or partially prealloyed powder and C is present as graphite; compacting the powder into the desired shape and sintering the compact at a temperature above 1150° C.

10. A powder-metallurgically produced, high temperature sintered product prepared from a powder according to claim 1.

11. A powder according to claim 2, characterised in that the amount of Cu is 1.0–2.5% by weight.

12. A powder according to claim 3, characterised in that the amount of Cu is 1.0–2.5% by weight.

13. A powder according to claim 12, characterised in that the amount of Cu is 1.0–2.5% by weight.

14. A powder according to claim 2, characterised in that the amount of Mn is 0.08–0.18% by weight.

15. A powder according to claim 3, characterised in that the amount of Mn is 0.08–0.18% by weight.

16. A powder according to claim 2, characterised in that the amount of C is 0.3–0.8% by weight.

17. A powder according to claim 3, characterised in that the amount of C is 0.3–0.8% by weight.

18. A powder-metallurgically produced, high temperature sintered product prepared from a powder according to claim 2.

19. A powder-metallurgically produced, high temperature sintered product prepared from a powder according to claim 3.

20. A powder-metallurgically produced, high temperature sintered product prepared from a powder according to claim 4.

* * * * *